US009865276B2

(12) United States Patent
Bonada et al.

(10) Patent No.: US 9,865,276 B2
(45) Date of Patent: Jan. 9, 2018

(54) VOICE PROCESSING METHOD AND APPARATUS, AND RECORDING MEDIUM THEREFOR

(71) Applicant: Yamaha Corporation, Hamamatsu-shi, Shizuoka-Ken (JP)

(72) Inventors: Jordi Bonada, Barcelona (ES); Merlijn Blaauw, Barcelona (ES); Keijiro Saino, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 70 days.

(21) Appl. No.: 14/980,517

(22) Filed: Dec. 28, 2015

(65) Prior Publication Data

US 2016/0189725 A1 Jun. 30, 2016

(30) Foreign Application Priority Data

Dec. 25, 2014 (JP) ..... 2014-263512

(51) Int. Cl.

| | |
|---|---|
| ***G10L 21/013*** | (2013.01) |
| ***G10L 25/45*** | (2013.01) |
| ***G10L 21/02*** | (2013.01) |
| ***G10L 21/003*** | (2013.01) |

(52) U.S. Cl.

CPC ..... *G10L 21/02* (2013.01); *G10L 21/003* (2013.01); *G10L 2021/0135* (2013.01)

(58) Field of Classification Search

CPC ..... G10L 21/003; G10L 25/90
USPC ..... 704/207
See application file for complete search history.

(56) References Cited

U.S. PATENT DOCUMENTS 3,697,699 A * 10/1972 Gluth ..... G10L 19/00 704/258
3,703,609 A * 11/1972 Gluth ..... G10L 19/00 331/78
4,076,958 A * 2/1978 Fulghum ..... G10L 19/02 704/268

(Continued)

FOREIGN PATENT DOCUMENTS

JP 2014-2338 A 1/2014

*Primary Examiner* — Paras D Shah
*Assistant Examiner* — Oluwadamilola M Ogunbiyi
(74) *Attorney, Agent, or Firm* — Crowell & Moring LLP

(57) ABSTRACT

A processing unit of a voice processing apparatus first generates a target voice signal in a time domain by adjusting a fundamental frequency of a target voice signal to a fundamental frequency of an initial voice signal, so as to generate a spectrum of the target voice signal after pitch is adjusted. Second, the processing unit reallocates, along a frequency axis, the spectrum of the target voice characteristics by having the spectrum correspond to each of the fundamental frequencies of the initial voice signal. The processing unit then generates a converted spectrum by adjusting component values of the spectrum of the target voice characteristics, which spectrum has been reallocated, so as to correspond to the component values of the spectrum of the initial voice signal, and by adapting the component values of the spectrum of the initial voice signal to specific frequency bands of the spectrum of the target voice characteristics, with each specific frequency band including one of the harmonic frequencies corresponding to the fundamental frequency of the initial voice signal.

19 Claims, 5 Drawing Sheets

(56) References Cited

U.S. PATENT DOCUMENTS

| | | | | |
|---|---|---|---|---|
| 5,327,521 | A * | 7/1994 | Savic | G10L 21/00 704/200 |
| 5,787,387 | A * | 7/1998 | Aguilar | G10L 19/06 704/207 |
| 9,396,740 | B1 * | 7/2016 | Bradley | G10L 25/90 |
| 2008/0033726 | A1 * | 2/2008 | Kudoh | G10L 21/04 704/268 |
| 2009/0107322 | A1 * | 4/2009 | Akiyama | G10H 1/0091 84/616 |
| 2011/0125493 | A1 * | 5/2011 | Hirose | G10L 21/003 704/207 |
| 2011/0125494 | A1 * | 5/2011 | Alves | G10L 21/0208 704/226 |
| 2012/0095767 | A1 * | 4/2012 | Hirose | G10L 13/033 704/258 |
| 2012/0197634 | A1 * | 8/2012 | Ishikawa | G10L 21/043 704/201 |
| 2014/0006018 | A1 | 1/2014 | Bonada et al. | |
| 2015/0032447 | A1 * | 1/2015 | Gunawan | G10L 25/84 704/233 |

* cited by examiner

VOICE PROCESSING METHOD AND APPARATUS, AND RECORDING MEDIUM THEREFOR

BACKGROUND OF THE INVENTION

1. Technical Field of the Invention

The present invention relates to technology for processing a voice signal.

2. Description of the Related Art

A technology for converting voice characteristics is proposed, for example, in Japanese Patent Application Laid-Open Publication No. 2014-002338 (hereinafter referred to as "JP 2014-002338"). This reference discloses a technology for converting voice characteristics of a voice signal that is a processing target (hereinafter referred to as "target signal") into distinguishing (non-modal or non-harmonic) voice characteristics such as gruffness or hoarseness. In the technology disclosed in JP 2014-002338, a spectrum of a target voice signal that has been adjusted to a fundamental frequency of an object signal is divided into segments comprising a plurality of bands (hereinafter referred to as "unit bands"), with a harmonic frequency residing at a center of each of the unit bands, and each component of each of the unit bands then being reallocated along a frequency axis. Next, amplitude and phase are adjusted for each of the unit bands such that an amplitude and phase of a harmonic frequency in each of the reallocated unit bands corresponds to an amplitude and phase of the target signal.

In the technology disclosed in JP 2014-002338 the amplitude and phase for each unit band is adjusted after a plurality of unit bands has been defined such that an intermediary point between a harmonic frequency and a next adjacent harmonic frequency on a frequency axis constitutes a boundary. A drawback of this technique is that an amplitude and phase at the boundary of each unit band (i.e., at the intermediary point between adjacent harmonic frequencies) become discontinuous. Presuming generation of a voice that has a predominance of harmonic components over non-harmonic components, with respect to the intermediary point between harmonic frequencies (i.e. at the point in which there is sufficiently low intensity) of the generated voice, any discontinuity in amplitude and phase of the non-harmonic components will hardly be perceived by a listener. However, where a particular subject voice that has a predominance of non-harmonic components, such as in the case of a gruff or hoarse voice, a discontinuity in the amplitude and phase at the intermediary point between harmonic frequencies becomes apparent, with the result that an acoustically unnatural voice may be perceived by the listener.

SUMMARY OF THE INVENTION

In view of the above-mentioned issues, an object of the present invention is to generate an acoustically natural voice from a voice type that has a predominance of non-harmonic components.

In one aspect, the present invention provides a voice processing method including: adjusting a fundamental frequency of a first voice signal of a voice having target voice characteristics to a fundamental frequency of a second voice signal of a voice having initial voice characteristics that differ from the target voice characteristics; allocating one of a plurality of unit band components in each one of a plurality of frequency bands, the plurality of the unit band components being obtained dividing into segments a spectrum of the first voice signal of the fundamental frequency that is adjusted to the fundamental frequency of the second voice signal, where a plurality of harmonic frequencies corresponds to the second fundamental frequency constituting boundaries, with each frequency band being defined by two harmonic frequencies from among the plurality of harmonic frequencies corresponding to the second fundamental frequency, such that one unit band component is disposed adjacent a corresponding one unit band component in a spectrum of the first voice signal of the fundamental frequency before adjustment to the fundamental frequency of the second voice signal; and generating a converted spectrum by adjusting component values of each of the unit band components after allocation, in accordance with component values of a spectrum of the second voice signal, and by adapting component values of the spectrum of the second voice signal to each of a plurality of specific bands of the spectrum of the first voice signal of the unit band components after allocation, with each specific band including one of the harmonic frequencies corresponding to the second fundamental frequency.

Preferably, the unit band components are allocated such that the band of a unit band component substantially matches a frequency band (i.e., pitch) defined by two harmonic frequencies and corresponding to the second fundamental frequency. The band of a unit band component may or may not entirely match the frequency band. However, even if the band of a unit band component after the allocation does not match a frequency band defined by two harmonic frequencies adjacent each other on the frequency axis corresponding to the second fundamental frequency, so long as the difference between a pitch corresponding to the second voice signal and that corresponding to the converted spectrum is not perceivable by the listener, for all practical purposes it can be said that a substantial match is attained. A typical example of two harmonic frequencies defining a frequency band is two harmonic frequencies that are adjacent each other along a frequency axis from among the plurality of harmonic frequencies corresponding to the second fundamental frequency.

In the above configuration, since component values are adjusted for each of a plurality of unit band components obtained by segmenting, with a plurality of harmonic frequencies corresponding to the second fundamental frequency and constituting boundaries, after a spectrum of the first voice signal of the fundamental frequency is adjusted to the fundamental frequency of the second voice signal, a discontinuity of component values in a non-harmonic component between harmonic frequencies is reduced. Therefore, in comparison with a configuration in which a plurality of unit band components are defined with a point between harmonic frequencies constituting the boundary, the present invention has an advantage of generating an acoustically natural voice despite the source voice containing a predominance of non-harmonic components. However, since a plurality of unit band components is defined with a plurality of harmonic frequencies constituting boundaries, a discontinuity in component values at a harmonic frequency can be problematic. In the above aspect of the present invention, since the component values of the second voice signal are applied to a specific band including a harmonic frequency, the present invention has an advantage of reducing the discontinuity in the component values at the harmonic frequency, so as to accurately reproduce target voice characteristics.

The bandwidth of each specific band preferably is a predetermined value common to the plurality of specific bands, or it may be variable. In a case where the bandwidth of each specific band is variable and where the component values include amplitude components, a specific band corresponding to each harmonic frequency may be defined by two end points, each of which has a respective smallest amplitude component value relative to each harmonic frequency in-between. Alternatively, each specific band may be set so as to enclose each of a plurality of peaks in a spectrum of the first voice signal after allocation of the unit band components. Variable specific bands are advantageous in that the specific bands are set to have bandwidths suited to characteristics of the spectrum after allocation of unit band components.

In one aspect, the component values of each unit band component may be adjusted such that a component value at one of the harmonic frequencies corresponding to the second fundamental frequency, the component value being one of the component values of each unit band component after allocation, matches a component value at the same harmonic frequency in the spectrum of the second voice signal. This configuration is advantageous in that a voice signal is generated that accurately maintains phonemes of the second voice signal. This is because component values at the harmonic frequency, of the respective unit band components after allocation, are adjusted to correspond to the component values at the harmonic frequency of the spectrum of the second voice signal.

In one aspect, where the component values include phase components, adjusting the component values may include changing phase shift quantities for respective frequencies in each of the unit band components such that shifting quantities along the time axis of respective frequency components included in each of the unit band components after allocation remain unchanged. Since this configuration sets phase shift quantities that vary for respective frequencies in a unit band component such that shifting quantities along the time axis of the respective frequencies remain unchanged, a voice that accurately reflects the target characteristics can be generated. This configuration is described in the third embodiment of the present specification by way of a non-limiting example.

In one aspect, the voice processing method further segments the first voice signal into a plurality of unit periods along the time axis, so as to calculate a spectrum of the first voice signal for each of the unit periods, wherein the plurality of unit periods is segmented by use of an analysis window that has a predetermined positional relationship with respect to each of peaks in a time waveform of the first voice signal of the fundamental frequency after adjustment, in a fundamental period corresponding to the second fundamental frequency; and segments the second voice signal into a plurality of unit periods along the time axis, so as to calculate a spectrum of the second voice signal for each of the unit periods, with the plurality of unit periods being segmented by use of an analysis window having the predetermined positional relationship with respect to each of peaks in a time waveform of the second voice signal in the fundamental period corresponding to the second fundamental frequency. In this configuration, since the positional relationship of the analysis window to each peak in a time waveform of the first voice signal is the same as that of the analysis window with regard to each peak in a time waveform of the second voice signal, a voice that accurately reflects the target characteristics of the first voice signal can be generated.

Preferably, as a form of the predetermined relationship, the analysis window used for segmenting the first voice signal has its center at a peak of a time waveform of the first voice signal, and the analysis window used for segmenting the second voice signal has a center at each peak of the time waveform of the second voice signal, the analysis window constituting a function wherein, when the center of the analysis window matches each peak in a time waveform, its center is a maximum value. In this way, it is possible to generate a spectrum in which each peak of a time waveform can be accurately reproduced.

In some aspects, the present invention may be identified as a voice processing apparatus that executes the voice processing method of each of the above aspects or as a computer recording medium having recorded thereon a computer program, stored in a computer memory, that causes a computer processor to execute the voice processing method of each of the aspects.

DESCRIPTION OF THE EMBODIMENTS

First Embodiment

Figure 1:
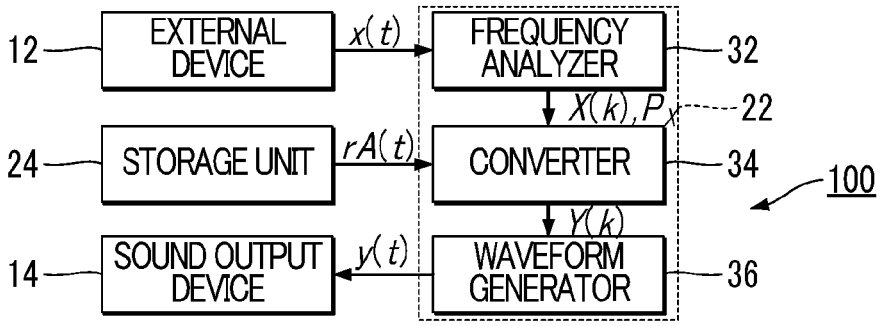
FIG. 1 is a block diagram of a voice processing apparatus according to a first embodiment of the present invention.

FIG. 1 is a block diagram of a voice processing apparatus 100 according to a first embodiment of the present invention. A voice signal (initial voice signal) x(t) is supplied to the voice processing apparatus 100 from an external device 12. The voice signal x(t) is a signal of a time domain that represents a voice, such as a conversing or singing voice, and which has been voiced with a particular pitch and phonemes (content of voice) (t: time). For example, a sound acquisition device that generates the voice signal x(t) by collecting ambient sound, a playback device that acquires the voice signal x(t) from a portable or built-in recording medium and outputs the same, or a communication device that receives the voice signal x(t) from a communication network and outputs the same can be used as the external device 12.

The voice processing apparatus 100 is a signal processing apparatus that generates a voice signal y(t) of the time domain that corresponds to a voice having particular characteristics (hereinafter referred to as "target voice characteristics") that are different from the characteristics of the voice signal x(t) (hereinafter referred to as "initial voice characteristics"). The target voice characteristics according to the present embodiment are distinctive (non-modal or non-harmonic), compared to the initial voice characteristics. Specifically, the characteristics of a voice created by action of a vocal cord, which action is different from that of a normal voicing, are suitable as the target voice characteristics. As an example, distinguishing characteristics (gruffness, roughness, harshness, growl, or hoarseness) of a voice, such as a gruff voice (including rough voice and growling voice) or hoarse voice, may be exemplified as such target voice characteristics. The target voice characteristics and the initial voice characteristics typically are those of different speakers. Alternatively, different voice characteristics of a single speaker may be used as target voice characteristics and initial voice characteristics. The voice signal y(t) generated by the voice processing apparatus 100 is supplied to a sound output device 14 (speakers and headphones) and output as sound waves.

As FIG. 1 illustrates, the voice processing apparatus 100 is implemented by a computer system having a processing unit 22 as a general processing device (e.g., CPU: central processing unit) and a storage unit 24. The storage unit 24 stores computer programs executed by the processing unit 22 and data used by the processing unit 22. Specifically, the storage unit 24 of the present embodiment stores a voice signal (hereinafter referred to as "target voice signal") rA(t) which is a voice signal of the time domain that represents a voice having target characteristics. The target voice signal rA(t) is a sample series of a voice having target characteristics that is obtained by steadily voicing a specific phoneme (typically a vowel) at a substantially constant pitch. A known recording medium such as a semiconductor recording medium and a magnetic recording medium or a combination of various types of recording media may be employed as the storage unit 24. The target voice signal rA(t) is an example of a "first voice signal", and the voice signal x(t) is an example of a "second voice signal". Alternatively, the voice processing apparatus 100 may be implemented by electronic circuitry dedicated to processing voice signals.

The processing unit 22 implements a plurality of functions (functions of a frequency analyzer 32, a converter 34, and a waveform generator 36) for generating the voice signal y(t) from the voice signal x(t) by executing a computer program stored in the storage unit 24. The voice processing method of the present embodiment is thus implemented via cooperation between the processing unit 22 and the computer program.

For some aspects, the functions of the processing unit 22 may be distributed among a plurality of apparatuses. For some aspects, a part of the functions of the processing unit 22 may be implemented by electric circuitry specialized in voice processing. For some aspects, the processing unit 22 may process the voice signal x(t) of a synthetic voice, which has been generated by a known voice synthesizing process, or may process the voice signal x(t), which has been stored in the storage unit 24 in advance. In these cases, the external device 12 may be omitted.

The computer program of the present embodiment may be stored on a computer readable recording medium, or may be installed in the voice processing apparatus 100 and stored in the storage unit 24. The recording medium is, for example, a non-transitory recording medium, a good example of which is an optical recording medium such as a CD-ROM, and may also be any type of publically known recording medium such as a semiconductor recording medium and a magnetic recording medium. Alternatively, the computer program of the present embodiment may be distributed through a communication network and installed in the voice processing apparatus 100 and stored in the storage unit 24. An example of such a recording medium is a hard disk or the like of a distribution server having recorded thereon the computer program of the present embodiment.

The frequency analyzer 32 generates a spectrum (complex spectrum) X(k) of the voice signal x(t). Specifically, the frequency analyzer 32, by use of an analysis window (e.g., a Hanning window) represented by a predetermined window function, calculates the spectrum X(k) sequentially for each unit period (frame) obtained by segmenting the voice signal x(t) along the time axis. Here, the symbol k denotes a freely-selected frequency from among a plurality of frequencies that is set on the frequency axis. The frequency analyzer 32 of the first embodiment sequentially identifies a fundamental frequency (pitch) $P_X$ of the voice signal x(t) for each unit period. The present embodiment may employ a freely-selected one of known pitch detection methods to specify the fundamental frequency $P_X$.

The converter 34 converts the initial voice characteristics into the target voice characteristics of the voice signal x(t) while maintaining the pitch and phonemes of the voice signal x(t). Specifically, the converter 34 of the present embodiment sequentially generates, for each unit period, a spectrum (hereinafter referred to as "converted spectrum") Y(k) of the voice signal y(t) having target characteristics through a converting process using the spectrum X(k) generated for each unit period by the frequency analyzer 32 and the target voice signal rA(t) stored in the storage unit 24. The process performed by the converter 34 will be described below in detail.

The waveform generator 36 generates the voice signal y(t) of the time domain from the converted spectrum Y(k) generated by the converter 34 for each unit period. It is preferable to use a short-time inverse Fourier transformation to generate the voice signal y(t). The voice signal y(t) generated by the waveform generator 36 is supplied to the sound output device 14 and output as sound waves. It is also possible to mix the voice signal x(t) and the voice signal y(t) in either the time domain or the frequency domain.

Figure 2A:
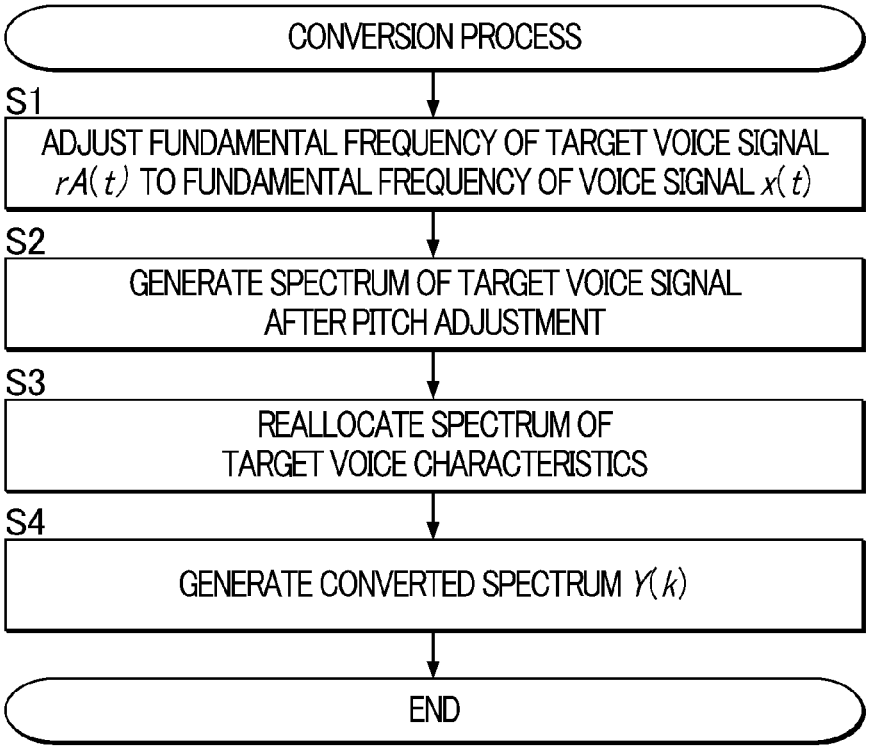
FIG. 2A is a flowchart of a conversion process.

A detailed configuration and operation of the converter 34 will now be described. FIG. 2A is a flow chart showing a general operation of the conversion performed by the processing unit 22 (the converter 34). As FIG. 2A shows, the processing unit 22 first generates the target voice signal in the time domain by adjusting the fundamental frequency of the target voice signal rA(t) to the fundamental frequency of the voice signal x(t) (S1). Second, the processing unit 22 generates the spectrum of the target voice signal after adjustment of the pitch (S2). Then, the processing unit 22 reallocates, along the frequency axis, the spectrum of the target voice characteristics by having the spectrum correspond to each of the plurality of fundamental frequencies that correspond to the fundamental frequencies after adjustment of the pitch (S3). The processing unit 22 generates the converted spectrum Y(k) by adjusting the component values (amplitude and phase) of the spectrum of the target voice characteristics after the spectrum is reallocated so as to correspond to the component values of the spectrum of the voice signal x(t), and by adapting the component values of the spectrum of the voice signal x(t) to specific frequency bands, each of which includes respective ones of the plurality of harmonic frequencies corresponding to the fundamental frequency after adjustment of the pitch (S4).

Figure 2B:
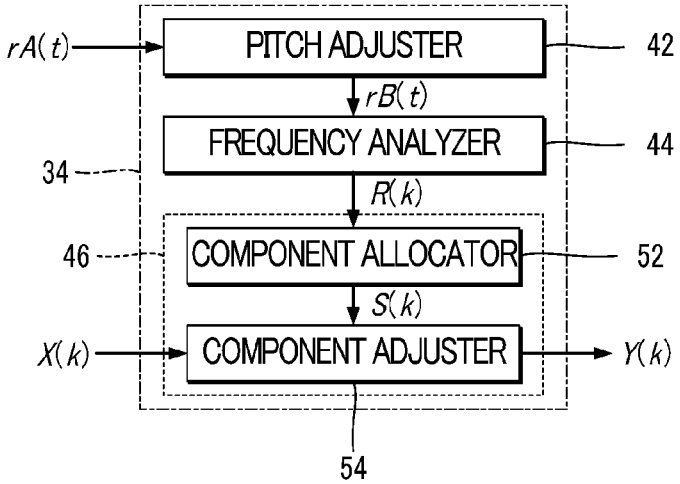
FIG. 2B is a block diagram of a converter.
Figure 3:
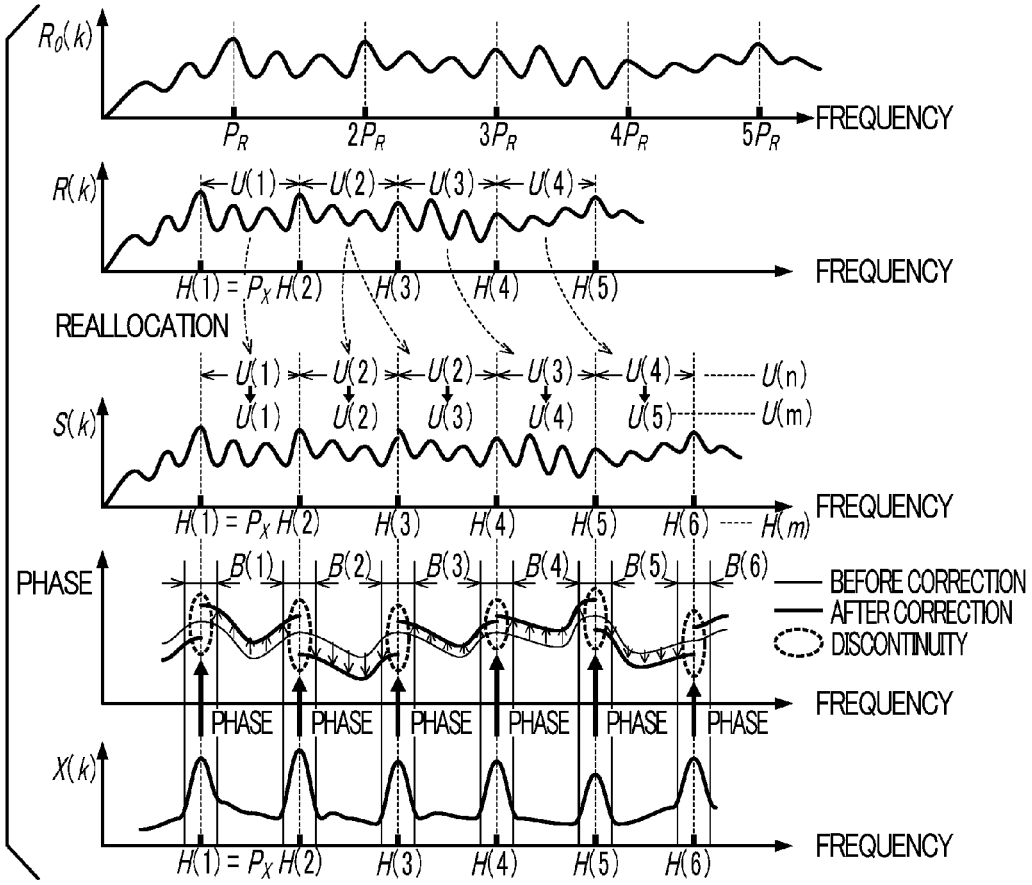
FIG. 3 illustrates an operation of the converter.

FIG. 2B is a block diagram of the converter 34. As illustrated in FIG. 2B, the converter 34 of the present embodiment has a pitch adjuster 42, a frequency analyzer 44, and a voice characteristic converter 46. FIG. 3 illustrates an operation of the converter 34.

The pitch adjuster 42 generates a target voice signal rB(t) of the time domain by adjusting a fundamental frequency (first fundamental frequency) $P_R$ of the target voice signal rA(t) stored in the storage unit 24 into a fundamental frequency (second fundamental frequency) $P_X$ of the voice signal x(t) identified by the frequency analyzer 32. Specifically, the pitch adjuster 42 generates the target voice signal rB(t) of the fundamental frequency $P_X$ by re-sampling the target voice signal rA(t) in the time domain. Therefore, the phonemes of the target voice signal rB(t) are substantially the same as those of the target voice signal rA(t), which is pre-adjusted. The rate of re-sampling by the pitch adjuster 42 is set to a rate λ ($\lambda=P_X/P_R$) of the fundamental frequency $P_X$ to the fundamental frequency $P_R$. The present embodiment may employ a freely selected one of known pitch detection methods to identify the fundamental frequency $P_R$ of the target voice signal rA(t). Alternatively, the fundamental frequency $P_R$, along with the target voice signal rA(t), may be stored in advance in the storage unit 24 and used to calculate the rate λ.

The frequency analyzer 44 of FIG. 2B generates a spectrum (complex spectrum) R(k) of the target voice signal rB(t) that has been adjusted by the pitch adjuster 42 (the operation by the pitch adjuster 42, hereinafter, referred to as "pitch adjustment"). Specifically, the frequency analyzer 44 sequentially calculates the spectrum R(k) for each unit period obtained by segmenting the target voice signal rB(t) on the time axis by use of an analysis window that is predetermined by a window function. In the present embodiment, there may be employed a freely selected one of known frequency analysis methods such as a short-time Fourier transformation, for calculation of the spectrum X(k) by the frequency analyzer 32 and for calculation of the spectrum R(k) by the frequency analyzer 44.

FIG. 3 shows the spectrum R(k) of the target voice signal rB(t) generated by the frequency analyzer 44 and also, as an aid, a spectrum $R_0(k)$ of the target voice signal rA(t) before adjustment of the pitch by the pitch adjuster 42. As FIG. 3 shows, the spectrum R(k) after pitch adjustment is either an even expansion or compression, at a rate λ, of the spectrum $R_0(k)$ before pitch adjustment.

The voice characteristic converter 46 of FIG. 2B sequentially generates for each unit period the converted spectrum Y(k) of the voice signal y(t) generated by voicing the pitch and phonemes of the voice signal x(t) with the target voice characteristics using the spectrum X(k) having the initial voice characteristics and the spectrum R(k) having the target voice characteristics, the spectrum X(k) being generated by the frequency analyzer 32 for each unit period of the voice signal x(t) of the initial voice characteristics and the spectrum R(k) being generated by the frequency analyzer 44 for each unit period of the target voice signal rB(t). As FIG. 2B shows, the voice characteristic converter 46 of the present embodiment includes a component allocator 52 and a component adjuster 54.

As FIG. 3 shows, the component allocator 52 generates a spectrum (hereinafter referred to as "reallocated spectrum") S(k) obtained by reallocating, along the frequency axis, a plurality of components (hereinafter referred to as "unit band components") U(n), which are obtained by segmenting, along the frequency axis, the spectrum R(k) having the target voice characteristics such that the spectrum R(k) is divided with each harmonic frequency H(n) constituting a boundary, corresponding to the fundamental frequency $P_X$ after pitch adjustment is carried out by the pitch adjuster 42. The harmonic frequency H(n) is n times the fundamental frequency $P_X$ (n being a natural number). In other words, a harmonic frequency H(1) corresponds to the fundamental frequency $P_X$, and each harmonic frequency H(n) of the second order or higher (n=2, 3, 4 . . . ) corresponds to a higher order harmonic frequency $n*P_X$ of the nth order.

As will be understood from FIG. 3, compared to a voice with normal voice characteristics, the spectrum R(k) of the target voice signal rB(t) contains a predominance of non-harmonic components, which reside between a harmonic frequency H(n) and the next adjacent harmonic frequency H(n+1) on the frequency axis. Namely; the voice of the target voice signal rB(t) of the present embodiment has distinguishing target voice characteristics, as in the case of a gruff or hoarse voice. In other words, non-harmonic components are important sound components that characterize an acoustic impression of target voice characteristics. Each unit band component U(n) of the first embodiment is a signal component of each of bands that are obtained by segmenting the spectrum R(k) with each harmonic frequency H(n) along the frequency axis constituting the boundary (end point). Specifically, a unit band component U(n) of the order of n corresponds to a band component of harmonic frequencies H(n) to H(n+1) of the spectrum R(k) of the target voice signal rB(t). Therefore, in each unit band component U(n), a non-harmonic component, which exists between the harmonic frequency H(n) and the harmonic frequency H(n+1) and characterizes the acoustic impression of the target voice characteristics, is maintained in a degree equivalent to the spectrum R(k).

As FIG. 3 shows, the shape of the spectrum R(k) after pitch adjustment and that of the spectrum $R_0(k)$ before pitch adjustment differ in corresponding bands. Therefore, the voice characteristics of the spectrum R(k) after pitch adjustment and the target voice characteristics of the spectrum $R_0(k)$ may differ. In order to accurately reproduce the target voice characteristics by reducing the above-mentioned difference, the component allocator 52 of the present embodiment generates the reallocated spectrum S(k) by allocating one of the multiple unit band components U(n) substantially in a range of frequencies (frequency band) from harmonic frequencies H(n) to H(n+1), with the harmonic frequency H(n) corresponding to the fundamental frequency $P_X$ after being pitch-adjusted, such that each unit band component U(n) is disposed adjacent a frequency component corresponding to the same unit band component U(n) in the spectrum $R_0(k)$ before being pitch-adjusted. In other words, the unit band component U(n) of the order of n is disposed near a harmonic frequency of the order of n of the spectrum $R_0(k)$ of the target voice signal rA(t). As a result of the reallocation as described above, the reallocated spectrum S(k) of the fundamental frequency $P_X$, which is shaped similarly to the spectrum $R_0(k)$ of the target voice characteristics compared to the spectrum R(k) before reallocation, is generated.

Specifically, when the fundamental frequency $P_X$ of the voice signal x(t) is less than the fundamental frequency $P_R$ of the target voice signal rA(t), as shown in FIG. 3, a first unit band component U(1) is allocated substantially in a range of frequencies between a harmonic frequency H(1) disposed adjacent the fundamental frequency $P_R$ of the target voice signal rA(t) before being pitch-adjusted and a harmonic frequency H(2), and a second unit band component U(2) is repetitively allocated substantially in two consecutive ranges of frequencies, one from the harmonic frequency H(2) and the other from a harmonic frequency H(3), that are disposed adjacent a second order harmonic frequency $2P_R$ of the target voice signal rA(t) before being pitch-adjusted. A unit band component U(3) of the third order is allocated substantially in a range of frequencies between a harmonic frequency H(4) disposed adjacent a third order harmonic frequency $3P_R$ of the target voice signal rA(t) and a harmonic frequency H(5). As will be understood from the above description, when the fundamental frequency $P_X$ of the voice signal x(t) is less than the fundamental frequency $P_R$ of the target voice signal rA(t) (λ<1), one or more of the unit band component U(n) is disposed repetitively (duplicated) along the frequency axis as deemed necessary. On the other hand, when the fundamental frequency $P_X$ is greater than the fundamental frequency $P_R(\lambda>1)$, an appropriate one or more of the unit band components U(n) is selected and disposed along the frequency axis.

In view of the repetition and selection of one or more unit band component U(n) as mentioned above, in the following description, the number n of each unit band component U(n) after reallocation by the component allocator 52 is renewed sequentially to a number (index) m starting from the end with a lower frequency. Specifically, the symbol m is represented by the following Equation (1).

$$m = \left\langle \frac{n}{\lambda} + 0.5 \right\rangle \tag{1}$$

In Equation (1), < > denotes a floor function. That is, a function <x+0.5> is an arithmetic operation for rounding a numerical value x to the nearest integer. As will be understood from the above description, the reallocated spectrum S(k), which has a plurality of unit band components U(m) arranged along the frequency axis, is generated. A unit band component U(m) of the reallocated spectrum S(k) is a band component of harmonic frequencies H(m) to H(m+1).

The component adjuster 54 of FIG. 2B generates an intermediary spectrum $Y_0(k)$ by adjusting component values (amplitudes and phases) of each unit band component U(m) after reallocation by the component allocator 52 in accordance with the component values of the spectrum X(k) of the voice signal x(t). Specifically, the component adjuster 54 of the first embodiment calculates the intermediary spectrum $Y_0(k)$ according to the following Equation (2) in which the reallocated spectrum S(k) generated by the component allocator 52 is adopted. The symbol j of Equation (2) denotes an imaginary unit.

$$Y_0(k)=S(k)g(m)\exp(j\theta(m)) \tag{2}$$

The variable g(m) of Equation (2) is a correction value (gain) for adjusting the amplitudes of each unit band component U(m) of the reallocated spectrum S(k) according to the amplitudes of the spectrum X(k) of the voice signal x(t), and it is represented by the following Equation (3).

$$g(m) = \frac{A_X(m)}{A_H(m)} \tag{3}$$

The symbol $A_H(m)$ of Equation (3) is the amplitude of the component of the harmonic component H(m) among the unit band component U(m), and the symbol $A_X(m)$ is the amplitude of the component of the harmonic frequency H(m) among the voice signal X(t). The common correction value g(m) is used for the amplitude correction of each frequency within any unit band component U(m). By the above-mentioned correction value g(m), the amplitude $A_H(m)$ at the harmonic frequency H(m) of the unit band component U(m) is corrected to the amplitude $A_X(m)$ at the harmonic frequency H(m) of the voice signal x(t).

Meanwhile, the symbol θ(m) of Equation (2) is a correction value (phase shift quantity) for adjusting the phase of each unit band component U(m) of the reallocated spectrum S(k) according to the phase of the spectrum X(k) of the voice signal x(t), and it is represented by Equation (4).

$$\theta(m) = \frac{\phi_X(m)}{\phi_H(m)} \tag{4}$$

The symbol $\Phi_H(m)$ of Equation (4) is the phase of the component of the harmonic frequency H(m) of the unit band component U(m), and the symbol $\Phi_X(m)$ is the phase of the component of the harmonic frequency H(m) of the voice signal x(t). The common correction value θ(m) is used for the phase correction of each frequency within any unit band component U(m). By the above-mentioned correction value θ(m), as shown in FIG. 3, the phase $\Phi_H(m)$ at the harmonic frequency H(m) of the unit band component U(m) is corrected to the phase $\Phi_X(m)$ at the harmonic frequency H(m) of the voice signal x(t), and the phase of each frequency of the unit band component U(m) changes the same amount as the phase shift quantity according to the correction value θ(m).

As will be understood from the above description, in the first embodiment, because each unit band component U(m) is defined with the harmonic frequency H(m) constituting the boundary, the continuity of the component values of the non-harmonic component between a harmonic frequency H(m) and the next harmonic frequency H(m+1) is retained before and after adjusting the component values (amplitudes and phases) by Equation (2). On the other hand, as a result of the reallocation of each unit band component U(m) by the component allocator 52 and the correction of the component value for each unit band component U(m) by the component adjuster 54, a discontinuity of the component values at each harmonic frequency H(m) may occur after the correction carried out by Equation 2 on the phase, as FIG. 3 illustrates. Because a harmonic component exists in each harmonic frequency H(m) of the reallocated spectrum S(k), the reproduced sound may impart an acoustically unnatural impression due to the discontinuity of the component values at each harmonic frequency H(m).

In order to reduce the above-mentioned discontinuity of the component value at each harmonic frequency H(m), as FIG. 3 illustrates with regard to the phase, the component adjuster 54 of the present embodiment generates the converted spectrum Y(k) by adapting the component values of the spectrum X(k) of the voice signal x(t) to a specific frequency band (hereinafter referred to as "specific band") B(m) that includes each harmonic frequency H(m) in the intermediary spectrum $Y_0(k)$, which is generated according to Equation (2). Specifically, the converted spectrum Y(k) is generated by replacing the component values of each specific band B(m) in the intermediary spectrum $Y_0(k)$ with the component values of said specific band B(m) in the spectrum X(k) of the voice signal x(t). The specific band B(m) is typically a frequency band having the harmonic frequency H(m) at the center. The bandwidth of each specific band B(m) is selected in advance either experimentally or statistically so as to enclose the peak corresponding to each harmonic frequency H(m) of the intermediary spectrum $Y_0(k)$. The converted spectrum Y(k), generated for each unit period by way of correction of the component values for each unit band component U(m) and replacement of the component values in the specific band B(m) as described above, is sequentially supplied to the waveform generator 36 and converted into the voice signal y(n) of the time domain.

As already mentioned, in a configuration in which the spectrum R(k) of the target voice signal rB(t) is segmented into a plurality of unit band components U(n) with the point between each harmonic frequencies H(n) and H(n+1) adjacent one another along the frequency axis, (e.g., the midpoint of the harmonic frequencies H(n) and H(n+1)) constituting the boundary, the component values of the non-harmonic component becomes discontinuous on the frequency axis. Presuming generation of a normal voice having a sufficiently low intensity in the non-harmonic component, the above discontinuity is hardly perceivable by the listener. However, because a distinguishing voice, such as a gruff or hoarse voice, contains a predominance of non-harmonic components, the discontinuity of the component values of the non-harmonic component becomes apparent and such a voice may be perceived as acoustically unnatural. In contrast with the above configuration, in the first embodiment, because the spectrum R(k) of the target voice signal rB(t) is segmented into a plurality of unit band components U(n) with each harmonic frequency H(n) constituting the boundary, there is no discontinuity in the component values of the frequency of the non-harmonic component after the correction of the component values for each unit band component U(n). Therefore, according to the first embodiment, a voice which contains a predominance of non-harmonic components and is acoustically natural can be generated.

On the other hand, in a configuration in which a plurality of unit band components U(n) is defined with each harmonic frequency H(n) constituting the boundary, the discontinuity of component values at the harmonic frequency H(n) may be problematic. Although a configuration is provided such that each unit band component U(n) is defined with each harmonic frequency H(m) constituting the boundary, in the first embodiment it is possible to avoid the discontinuity of component values at the harmonic frequency H(n) because the component values of the spectrum X(k) of the voice signal x(t) are appropriated for the specific band B(m) including the harmonic frequency H(m).

Also, in the first embodiment it is possible to generate the voice signal y(t) that accurately maintains the phonemes of the voice signal x(t) because the component values of each unit band component U(m) are adjusted such that the component values ($A_H(m)$ and $\Phi_H(m)$) at the harmonic frequency H(m), among the respective unit band components U(m) that have been reallocated by the component allocator 52, correspond with the component values ($A_X(m)$ and $\Phi_X(m)$) at the harmonic frequency H(m) of the spectrum X(k) of the voice signal x(t).

Second Embodiment

A second embodiment of the present invention is now explained.

In each embodiment illustrated below, the same reference numerals and signs will be used for those elements for which actions and elements are the same as those of the first embodiment, and description thereof will be omitted where appropriate.

Figure 4:
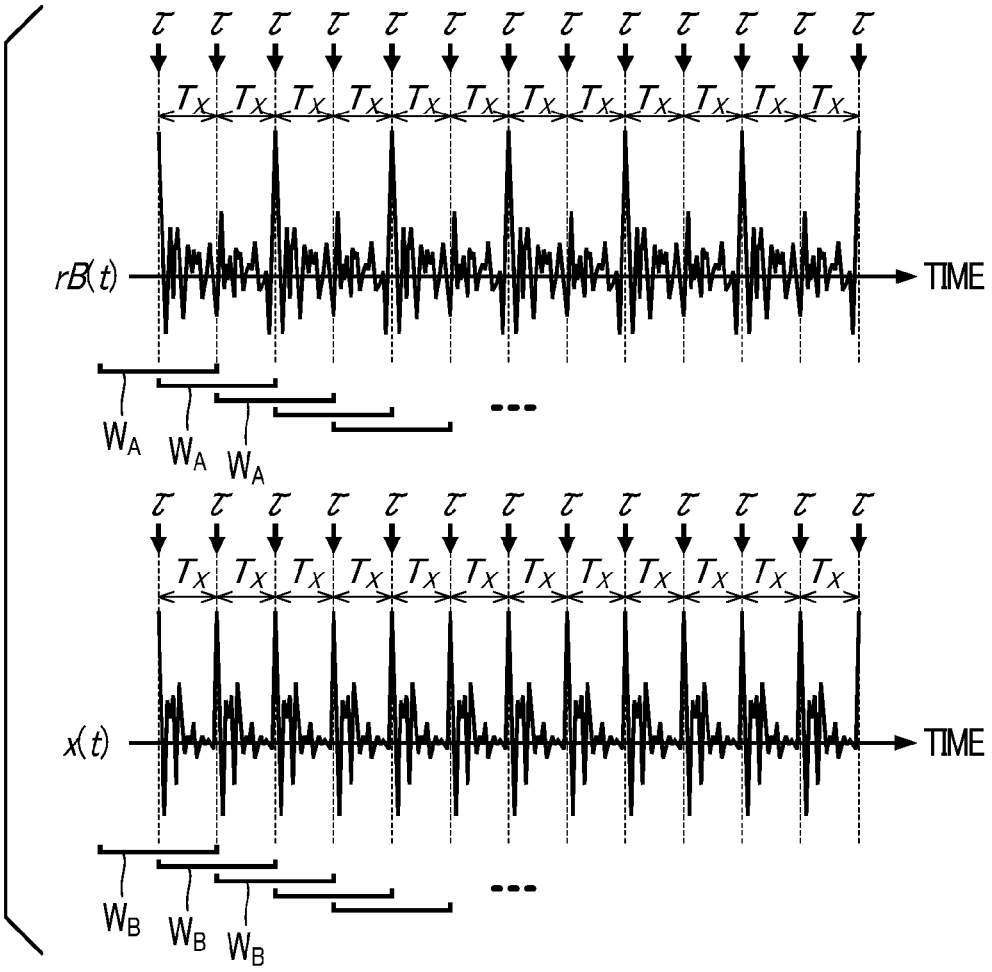
FIG. 4 illustrates an operation of each frequency analyzer according to a second embodiment of the present invention.

FIG. 4 illustrates both the time waveform of the target voice signal rB(t) after adjustment by the pitch adjuster 42 to the fundamental frequency $P_X$ and the time waveform of the voice signal x(t) having the fundamental frequency $P_X$. As FIG. 4 shows, a peak τ of the time waveform is observed for every fundamental cycle $T_X$ ($T_X=1/P_X$) that corresponds to the fundamental frequency $P_X$ in the target voice signal rB(t) and in the voice signal x(t). In the target voice signal rB(t) of a distinguishing voice such as a gruff or hoarse voice, the peak τ of a high intensity and peak τ of a low intensity tend to be generated in turn for each fundamental cycle $T_X$. In the voice signal x(t) of a normal voice, the peak τ of nearly the same intensity tends to be generated for each fundamental cycle $T_X$.

As FIG. 4 shows, the frequency analyzer 44 (first frequency analyzer) of the second embodiment detects the peak τ on the time axis of the target voice signal rB(t) and calculates the spectrum R(k) for each unit period, which is obtained by segmenting the target voice signal rB(t) using an analysis window $W_A$ corresponding to each peak τ. Similarly, the frequency analyzer 32 (second frequency analyzer) detects the peak τ on the time axis of the target voice signal x(t) and calculates the spectrum X(k) for each unit period, which is obtained by segmenting the target voice signal x(t) using an analysis window $W_B$ corresponding to each peak τ. The positional relationship of the analysis window $W_A$ to each peak τ of the target voice signal rB(t) and the positional relationship of the analysis window $W_B$ to each peak τ of the voice signal x(t) are common. Specifically, the analysis windows $W_A$ and $W_B$ are set so as to have their center at each peak τ. As the analysis windows $W_A$ and $W_B$ each are a function with its center being the maximum value, by matching the center with each peak τ, it is possible to generate a spectrum with the peak τ being reproduced with great precision. A freely selected one of known techniques may be employed to detect each peak τ. For example, among a plurality of time points at each of which signal intensity is maximized, each time point at an interval of the fundamental frequency $T_X$ can be detected as the peak τ.

Figure 5:
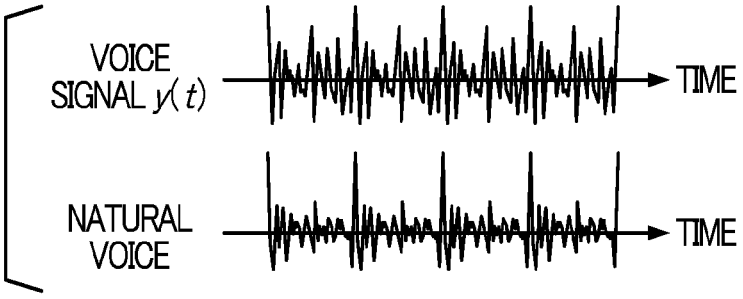
FIG. 5 illustrates a waveform of a voice signal generated in a comparative example.

FIG. 5 illustrates a waveform of the voice signal y(t) that is generated under a configuration (hereinafter referred to as "comparative example") in which the positional relationship of an analysis window to each peak τ on the time axis is different between the target voice signal rB(t) and the voice signal x(t). FIG. 5 also illustrates a time waveform of a hoarse voice (natural voice) that the speaker actually voiced. As will be understood from FIG. 5, the voice signal y(t) generated in the comparative example may consequently be perceived as an unnatural voice that is different from a natural voice because, compared to an actual hoarse voice, the peak of the waveform on the time axis of the voice signal y(t) is an ambiguous waveform. One of the causes of the difference in waveform is the difference in the phases (phase spectrum) of frequency components. Specifically, whereas the fundamental difference in the phases of frequency components between the target voice signal rB(t) and the voice signal x(t) may cause ambiguity of the waveform of the voice signal y(t), it may in actuality be concluded that the difference between the position on the time axis of the analysis window corresponding to the target voice signal rB(t) and the position on the time axis of the analysis window corresponding to the voice signal x(t) is the dominant cause of the ambiguity of the waveform of the voice signal y(t).

In the second embodiment, as described above referring to FIG. 4, the positional relationship of the analysis window $W_A$ corresponding to each peak τ of the target voice signal rB(t) and the positional relationship of the analysis window $W_B$ corresponding to each peak τ of the voice signal x(t) are common. Therefore, the ambiguity in the waveform of the voice signal y(t) caused by the difference in the position of the analysis windows is reduced. In other words, the second embodiment has an advantage of generating the voice signal y(t) of a natural hoarse voice in which striking peaks are observed for each fundamental cycle $T_X$, as in the case of the natural voice illustrated in FIG. 5. It is of note that the configuration of the first embodiment, in which each unit band component U(m) is defined with the harmonic frequency H(m) constituting the boundary, is not a requirement of the second embodiment. In other words, in the second embodiment, for example, each unit band component U(m) can be defined by having the point (e.g., the midpoint between the harmonic frequencies H(m)) between the harmonic frequencies H(m) adjacent each other on the frequency axis constituting the boundary.

Third Embodiment

As will be understood from the above mentioned Equations (2) and (4), in the first embodiment, there is described an example configuration in which the phases of all frequencies of a freely selected one unit band component U(m) are changed by the same correction quantity (phase shift quantity) θ(m) (i.e., a configuration in which the phase spectrum of the unit band component U(m) is moved in a parallel direction along the phase axis). However, in this configuration, the time waveform of the target voice signal rB(t) may change because the shift along the time axis, made through the phase shift with the correction value θ(m), is different for each frequency of the unit band component U(m).

In view of the above circumstances, the component adjuster 54 of the third embodiment sets a different correction value θ(m,k) for each frequency within the unit band component U(m) such that the shifts along the time axis of the frequency components, which are enveloped in each unit band component U(m) after allocation by the component allocator 52, are the same. Specifically, the component adjuster 54 calculates the correction value θ(m,k) of a phase according to the following Equation (5).

As will be understood from Equation (5), the correction value θ(m,k) of the third embodiment is a value obtained by multiplying the correction value θ(m) of the first embodiment by a coefficient $\delta_k$ that is frequency-dependent.

$$\theta(m, k) = \delta_k \frac{\phi_X(m)}{\phi_H(m)} = \frac{f_k}{H(m)} \frac{\phi_X(m)}{\phi_H(m)} \tag{5}$$

Figure 6:
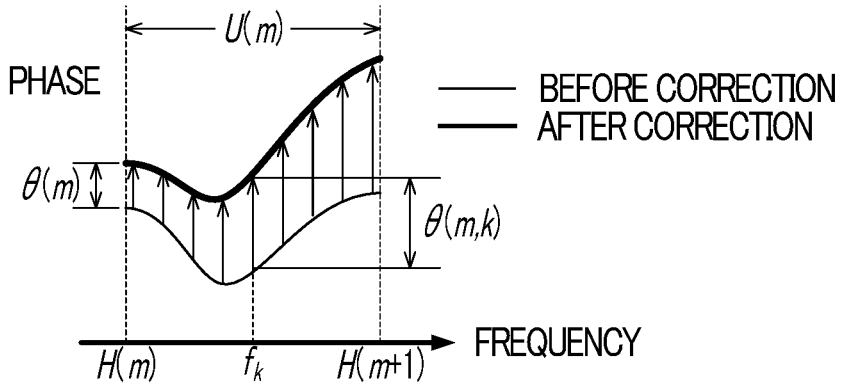
FIG. 6 illustrates a phase correction according to a third embodiment of the present invention.

$f_k$ in Equation 5 denotes a frequency of the order of k on the frequency axis. The coefficient $\delta_k$ used to calculate the correction value θ(m,k) is defined as a ratio of each frequency $f_k$ within the unit band component U(m) to the harmonic frequency H(m) of the order of m (i.e., the frequency $f_k$ at the left end of the band of the unit band component U(m)). In other words, as will be understood from FIG. 6, the correction value θ(m,k) becomes greater, the nearer a frequency is to the highest region within the unit band component U(m), and resulting shift amounts of the frequency components within the unit band component U(m) along the time axis will be the same. Therefore, the third embodiment can suppress the change in time waveform of the target voice signal rB(t) caused by the difference in the shift amounts along the time axis for frequencies of the unit band component U(m), and can generate the voice signal y(t) with the voice characteristics of the target voice signal rB(t) (and also the target voice signal rA(t)) being accurately reproduced. It is of note that it is possible to adapt the third embodiment to the second embodiment.

Modifications

The above-described embodiment can be modified in various manners. Detailed modifications will be described below. Two or more embodiments selected from the following embodiments can be combined as appropriate.

1. In the above mentioned embodiments, the target voice signal rB(t) of the fundamental frequency $P_X$ is generated by re-sampling the target voice signal rA(t) of the fundamental frequency $P_R$ in the time domain. However, it is also possible to generate the spectrum R(k) of the fundamental frequency $P_X$ by expanding or compressing the spectrum $R_0(k)$ of the target voice signal rA(t) along the frequency axis in the frequency domain.

2. In the above mentioned embodiments, both the amplitude and phase of the reallocated spectrum S(k) are corrected. However, it is also possible to correct one of either the amplitude or the phase. In other words, the component value that is the object of adjustment by the component adjuster 54 is at least one of either the amplitude or the phase. In a configuration in which only the amplitude is adjusted, it is possible to calculate an amplitude spectrum of the target voice signal rB(t) as the spectrum R(k). In a configuration in which only the phase is adjusted, it is possible to calculate a phase spectrum of the target voice signal rB(t) as the spectrum R(k).

3. In the above mentioned embodiments, the bandwidth of the specific band B(m) is set to a prescribed value that is common to a plurality of specific bands B(m). However, it is possible to set each bandwidth of a plurality of the specific band B(m) to a variable value. Specifically, the bandwidth of each specific band B(m) may be set to a variable value according to the characteristics of the reallocated spectrum S(k). In order to suppress the discontinuity of amplitude in the converted spectrum Y(k) of the voice signal y(t), a preferable configuration is to set the specific band B(m) with its end points being two frequencies at which amplitudes are minimized at opposite sides of the harmonic frequency H(m) of the reallocated spectrum s(k). For example, a range is set as the specific band B(m), the lower limit of the range being the frequency with the minimum amplitude that is the closest to the harmonic frequency H(m) within the lower region (H(m−1) to H(m)) of the harmonic frequency H(m), and the upper limit of the range being the frequency with the minimum amplitude that is closest to the harmonic frequency H(m) within the higher region (H(m) to H(m+1)) of the harmonic frequency H(m). Moreover, it is possible to set the bandwidth of the specific band B(m) to be variable according to the bandwidth of the unit band component U(m). In a configuration in which the bandwidth of each specific band B(m) is variable, such as in the above example, it is possible to set each specific band B(m) to a bandwidth suitable for the characteristics of the reallocated spectrum S(k) for example.

4. In the above mentioned embodiments, the voice signal x(t) supplied from the external device 12 is exemplified as the object of processing. However, the object of processing by the voice processing apparatus 100 is not limited to a signal output from the external device 12. Specifically, it is also possible for the voice processing apparatus 100 to process the voice signal x(t) generated by various voice synthesizing technologies. For example, the voice characteristics of the voice signal x(t) generated by a known voice synthesizing technology may be converted by the voice processing apparatus 100, examples of such technology being a piece-connecting voice synthesis that selectively connects a plurality of voice pieces recorded in advance, and a voice synthesis that uses a probability model such as the hidden Markov model.

5. It is also possible to implement the voice processing apparatus 100 in a server device (typically a web server) that communicates with terminal devices via a communication network such as a mobile communication network or the Internet. Specifically, the voice processing apparatus 100 generates, in the same manner as in the above mentioned embodiments, the voice signal y(t) from the voice signal x(t)

received from a terminal device via the communication network, and transmits it to the terminal device. By the above configuration, it is possible to provide users of terminal devices with a cloud service that acts as an agent in converting the voice characteristics of the voice signal x(t). Meanwhile, in a configuration in which the spectrum X(k) of the voice signal x(t) is transmitted from terminal devices to the voice processing apparatus 100 (for example, a configuration in which a terminal device has the frequency analyzer 32), the frequency analyzer 32 is omitted in the voice processing apparatus 100. Also, in a configuration in which the converted spectrum Y(k) is transmitted from the voice processing apparatus 100 to terminal devices (e.g., a configuration in which the terminal device has the waveform generator 36), the waveform generator 36 is omitted from the voice processing apparatus 100.

What is claimed is:

1. A voice processing method comprising:

adjusting, by at least one processor, a first fundamental frequency of a first voice signal of a voice having target voice characteristics according to a second fundamental frequency of a second voice signal of a voice having initial voice characteristics that differ from the target voice characteristics to obtain the first voice signal of the second fundamental frequency;

dividing, by the at least one processor, a spectrum of the first voice signal of the second fundamental frequency at a plurality of harmonic frequencies corresponding to the second fundamental frequency into a plurality of unit band components corresponding to a plurality of frequency bands, each of the frequency bands defined by two adjoining harmonic frequencies from among the plurality of harmonic frequencies corresponding to the second fundamental frequency;

allocating, by the at least one processor, one of the plurality of unit band components to each one of the plurality of frequency bands such that one unit band component is disposed adjacent a corresponding one unit band component in a spectrum of the first voice signal of the first fundamental frequency before the adjustment;

generating, by the at least one processor, a converted spectrum by adjusting, within each frequency band, component values of each of the unit band components after the allocation in accordance with component values of a spectrum of the second voice signal, and, for each of a plurality of specific bands of the spectrum of the first voice signal of the unit band components after the allocation, applying component values within a corresponding specific band of the spectrum of the second voice signal to each specific band, wherein each specific band includes a peak of one of the harmonic frequencies corresponding to the second fundamental frequency with each harmonic frequency constituting a boundary between the two frequency bands; and generating a synthesized voice signal by a voice synthesizer based on the generated converted spectrum.

2. The voice processing method according to claim 1, wherein a bandwidth of each specific band is a predetermined value common to the plurality of specific bands.

3. The voice processing method according to claim 1, wherein a bandwidth of each specific band is variable.

4. The voice processing method according to claim 3, wherein the component values include amplitude components, and wherein a specific band corresponding to each harmonic frequency is defined by two end points, each of which has a respective smallest amplitude component value relative to each harmonic frequency in-between.

5. The voice processing method according to claim 3, wherein each specific band is set so as to enclose each of a plurality of peaks in the spectrum of the first voice signal after allocation of the unit band components.

6. The voice processing method according to claim 1, wherein the component values of the each unit band component are adjusted such that a component value at one of the harmonic frequencies corresponding to the second fundamental frequency, the component value being one of the component values of each of the unit band components after allocation matches a component value at the same harmonic frequency in the spectrum of the second voice signal.

7. The voice processing method according to claim 1, wherein the component values include phase components, and wherein adjusting the component values includes changing phase shift quantities for respective frequencies in each of the unit band components such that shifting quantities along the time axis of respective frequency components included in each of the unit band components after allocation remain unchanged.

8. The voice processing method according to claim 1 further comprising:

segmenting the first voice signal into a plurality of unit periods along the time axis, so as to calculate a spectrum of the first voice signal for each of the unit periods, wherein the first voice signal is segmented by use of an analysis window that has a predetermined positional relationship with respect to each of peaks in a time waveform of the first voice signal of the fundamental frequency after adjustment, in a fundamental period corresponding to the second fundamental frequency; and segmenting the second voice signal into a plurality of unit periods along the time axis, so as to calculate a spectrum of the second voice signal for each of the unit periods, wherein the second voice signal is segmented by use of an analysis window that has the predetermined positional relationship with respect to each of peaks in a time waveform of the second voice signal in the fundamental period corresponding to the second fundamental frequency.

9. The voice processing method according to claim 8, wherein, as a form of the predetermined relationship, the analysis window used for segmenting the first voice signal has a center at each peak of the time waveform of the first voice signal, and the analysis window used for segmenting the second voice signal has a center at each peak of the time waveform of the second voice signal.

10. A voice processing apparatus comprising:

at least one processor configured to execute stored instructions to:

adjust a first fundamental frequency of a first voice signal of a voice having target voice characteristics according to a second fundamental frequency of a second voice signal of a voice having initial voice characteristics that differ from the target voice characteristics to obtain the first voice signal of the second fundamental frequency;

divide a spectrum of the first voice signal of the second fundamental frequency at a plurality of harmonic frequencies corresponding to the second fundamental frequency into a plurality of unit band components corresponding to a plurality of frequency bands, each of the frequency bands defined by two adjoining harmonic frequencies from among the plurality of harmonic frequencies corresponding to the second fundamental frequency;

allocate one of the plurality of unit band components to each one of the plurality of frequency bands such that one unit band component is disposed adjacent a corresponding one unit band component in a spectrum of the first voice signal of the first fundamental frequency before the adjustment;

generate a converted spectrum by adjusting, within each frequency band, component values of each of the unit band components after the allocation in accordance with component values of a spectrum of the second voice signal, and, for each of a plurality of specific bands of the spectrum of the first voice signal of the unit band components after the allocation, apply component values within a corresponding specific band of the spectrum of the second voice signal to each specific band, wherein each specific band includes a peak of one of the harmonic frequencies corresponding to the second fundamental frequency with each harmonic frequency constituting a boundary between the two frequency bands; and generating a synthesized voice signal by a voice synthesizer based on the generated converted spectrum.

11. The voice processing apparatus according to claim 10, wherein a bandwidth of each specific band is a predetermined value common to the plurality of specific bands.

12. The voice processing apparatus according to claim 10, wherein a bandwidth of each specific band is variable.

13. The voice processing apparatus according to claim 12, wherein the component values include amplitude components, and wherein a specific band corresponding to the each harmonic frequency is defined by two end points, each of which has a respective smallest amplitude component value relative to each harmonic frequency in-between.

14. The voice processing apparatus according to claim 12, wherein each specific band is set so as to enclose each of a plurality of peaks in the spectrum of the first voice signal after allocation of the unit band component values.

15. The voice processing apparatus according to claim 10, wherein the at least one processor is configured to adjust the component values of the each unit band component such that a component value at one of the harmonic frequencies corresponds to the second fundamental frequency, the component value being one of the component values of each unit band component after allocation by the component allocator, and match a component value at the same harmonic frequency in the spectrum of the second voice signal.

16. The voice processing apparatus according to claim 10, wherein the component values include phase components, and wherein the at least one processor is configured to change phase shift quantities for respective frequencies in each of the unit band components such that shifting quantities along the time axis of respective frequency components included in each unit band component after the allocation by the component allocator remain unchanged.

17. The voice processing apparatus according to claim 10, wherein the at least one processor is further configured to execute stored instructions to:

segment the first voice signal into a plurality of unit periods along the time axis, so as to calculate a spectrum for each of the unit periods, wherein the plurality of unit periods are segmented by use of an analysis window that has a predetermined positional relationship with respect to each of peaks in a time waveform of the first voice signal after the fundamental frequency of the first voice signal is adjusted in a fundamental period corresponding to the second fundamental frequency by the pitch adjuster; and segment the second voice signal into a plurality of unit periods along the time axis, so as to calculate a spectrum for each of the unit periods, wherein the plurality of unit periods are segmented by use of an analysis window that has the predetermined positional relationship with respect to each of peaks in a time waveform of the second voice signal in the fundamental period corresponding to the second fundamental frequency.

18. The voice processing apparatus according to claim 17, wherein, as a form of the predetermined relationship, the analysis window used for segmenting the first voice signal has a center at each peak of the time waveform of the first voice signal, and the analysis window used for segmenting the second voice signal has a center at each peak of the time waveform of the second voice signal.

19. A non-transitory computer readable medium storing executable instructions, the executable instructions when executed by at least one processor performs a voice processing method, the method comprising the steps of:

adjusting a first fundamental frequency of a first voice signal of a voice having target voice characteristics according to a second fundamental frequency of a second voice signal of a voice having initial voice characteristics that differ from the target voice characteristics to obtain the first voice signal of the second fundamental frequency;

dividing a spectrum of the first voice signal of the second fundamental frequency at a plurality of harmonic frequencies corresponding to the second fundamental frequency into a plurality of unit band components corresponding to a plurality of frequency bands, each of the frequency bands defined by two adjoining harmonic frequencies from among the plurality of harmonic frequencies corresponding to the second fundamental frequency;

allocating one of the plurality of unit band components to each one of the plurality of frequency bands such that one unit band component is disposed adjacent a corresponding one unit band component in a spectrum of the first voice signal of the first fundamental frequency before the adjustment;

generating a converted spectrum by adjusting, within each frequency band, component values of each of the unit band components after the allocation in accordance with component values of a spectrum of the second voice signal, and, for each of a plurality of specific bands of the spectrum of the first voice signal of the unit band components after the allocation, applying component values within a corresponding specific band of the spectrum of the second voice signal to each specific band, wherein each specific band includes a peak of one of the harmonic frequencies corresponding to the second fundamental frequency with each harmonic frequency constituting a boundary between the two frequency bands; and generating a synthesized voice signal by a voice synthesizer based on the generated converted spectrum.

* * * * *